US011072009B2

(12) United States Patent
Montemarani

(10) Patent No.: US 11,072,009 B2
(45) Date of Patent: Jul. 27, 2021

(54) METHOD FOR AUTOMATICALLY ADJUSTING THE STRAIGHTENING OF METAL ELEMENTS OF ELONGATED SHAPE AND APPARATUS FOR STRAIGHTENING THE SAME ELEMENTS

(71) Applicant: SCHNELL S.P.A., Colli al Metauro (IT)

(72) Inventor: Massimo Montemarani, Colli al Metauro (IT)

(73) Assignee: SCHNELL S.P.A., Colli al Metauro (IT)

( * ) Notice: Subject to any disclaimer, the term of this patent is extended or adjusted under 35 U.S.C. 154(b) by 341 days.

(21) Appl. No.: 16/095,135

(22) PCT Filed: Apr. 24, 2017

(86) PCT No.: PCT/IB2017/052340
§ 371 (c)(1),
(2) Date: Oct. 19, 2018

(87) PCT Pub. No.: WO2017/183010
PCT Pub. Date: Oct. 26, 2017

(65) Prior Publication Data

US 2019/0126334 A1 May 2, 2019

(30) Foreign Application Priority Data

Apr. 22, 2016 (IT) ..... 102016000042114

(51) Int. Cl.
*B21D 3/02* (2006.01)
*B21D 11/12* (2006.01)
*B21F 1/02* (2006.01)

(52) U.S. Cl.
CPC ..... *B21D 3/02* (2013.01); *B21D 11/12* (2013.01); *B21F 1/02* (2013.01)

(58) Field of Classification Search
CPC ... B21D 1/02; B21D 3/02; B21D 3/04; B21D 3/05; B21D 3/06; B21F 1/02; B21F 1/026
See application file for complete search history.

(56) References Cited

FOREIGN PATENT DOCUMENTS

DE 3729619 A1 3/1989
EP 0459869 A1 12/1991
(Continued)

*Primary Examiner* — Debra M Sullivan
(74) *Attorney, Agent, or Firm* — McGlew and Tuttle, P.C.

(57) ABSTRACT

The method for automatically adjusting the straightening of metal elements of elongated shape, in particular iron rods, provides to prearrange a drawing and/or straightening assembly (3) for straightening and feeding at least one metal element (2) of elongated shape along a feeding direction (A) on a work plane (5), at least theoretical, and a control assembly, predisposed to send to said drawing and/or straightening assembly (3) adjustment commands for the straightening parameters. Moreover, the method provides to prearrange a detection assembly (10) comprising at least a first detection member (11) arranged on a first detection plane (21), a second detection member (12) arranged on a second detection plane (22), predisposed to detect at least a first datum and a second datum respectively, each indicating the instantaneous value of a respective distance from a cross-section of the metal element (2) of elongated shape in the moment when it crosses the first detection plane (21) and the second detection plane (22) respectively, and an acquisition and processing device of said first datum and second datum.

19 Claims, 3 Drawing Sheets

(56) References Cited

FOREIGN PATENT DOCUMENTS

| | | | | |
|---|---|---|---|---|
| EP | 0916245 | A1 * | 5/1999 | ..... A01C 21/005 |
| EP | 0916425 | A1 | 5/1999 | |
| EP | 0947256 | A2 | 10/1999 | |
| JP | S5492561 | A | 7/1979 | |
| JP | S6182939 | A | 4/1986 | |
| JP | H06246341 | A | 9/1994 | |
| JP | H07 148537 | A | 6/1995 | |
| WO | 2016/063256 | A1 | 4/2016 | |

* cited by examiner

METHOD FOR AUTOMATICALLY ADJUSTING THE STRAIGHTENING OF METAL ELEMENTS OF ELONGATED SHAPE AND APPARATUS FOR STRAIGHTENING THE SAME ELEMENTS

TECHNICAL FIELD

The present invention concerns a method for automatically adjusting the straightening of metal elements of elongated shape, in particular iron rods, and an apparatus predisposed to carry out such method.

BACKGROUND ART

It has been known the use of apparatuses that carry out the straightening of metal elements of elongated shape, in particular of iron rods.

The straightening is a processing technique used in several fields. In particular, in the specific field of the processing of iron rods, intended for the reinforcement of reinforced concrete, there are specific exigencies to be considered.

The metal rods wound in rolls are generally fed from respective coils to be processed by machines equipped with suitable straightening apparatuses. These straightening apparatuses are commonly equipped with a series of working members predisposed to act on the metal rod being fed before it reaches the subsequent working stations, for example the cut station and, subsequently, sometimes, the bending station.

In practice, such straightening apparatuses are predisposed to eliminate the residual curvature caused by the winding of the rod as a roll or a coil. To this end, the straightening members subject the rod to suitable bending actions of intensity exceeding the elastic limit of the material, so as to substantially eliminate the residual curvature which, by elasticity, would tend to return to the original shape and thus make the straightening effect permanent.

Different types of apparatuses are currently known to straighten metal rods. According to a widely-known type, as illustrated, for example, in EP0459869 and EP0947256, these apparatuses comprise one or more straightening units consisting of a plurality of pairs of grooved wheels, opposed to the rod axis and counter-rotating, to engage the rod itself fed between them. The counter-rotating straightening wheels are arranged in succession and with parallel axes. For example, such apparatuses may include a first straightening unit and a second straightening unit, predisposed to mainly correct corresponding components of the curvature of the metal rod on different planes, for example on a horizontal plane and on a vertical plane.

More precisely, the material to be processed, that is, the metal rod, generally has an irregular shape, due in particular to the presence of ribs on the lateral surface, variable between two and four, looped around the longitudinal axis of the element itself.

In addition, the elements to be processed are provided with ribs which, in the reinforcing product, help the adherence to the covering material, usually concrete, giving a so-called "improved adhesion". The particular conformation and sizing of the ribs on the outer surface of the metal rod also serves to identify the type of element.

In substance, the elements that are subjected to straightening are generally very different, both because of the dimensional and the mechanical characteristics due to the different production, processing as well as the packaging technologies. In this respect, it is relevant that the elements to be straightened are unwound by rolls and therefore their characteristics may vary between winding turns, more internal or more external, as well as from roll to roll.

In straightening apparatuses, it is essential, in particular, to be able to adjust the straightening parameters according to the specific behaviour of the metal element being processed, precisely because of the extreme variability of the mechanical and geometric conditions affecting the straightening process.

Adjustment activities are currently being entrusted principally to the skill and experience of the operator that sets the straightening parameters after performing some test cycles. In particular, these cycles can highlight the reached degree of straightening and, therefore, indicate the processing parameter to be corrected.

Manual adjustment therefore requires the execution of repeated work cycles, resulting in time and material waste.

EP0916425 discloses an apparatus for straightening a profile in which a laser detection assembly is provided to detect the configuration of the same element outgoing from a rectifier assembly.

DE3729619 discloses a method and an apparatus for straightening tubular elements rotating about their own axis and longitudinally mobile. The patent illustrates a detection assembly consisting of laser-type elements.

JPS5492561 discloses a method for controlling an apparatus for automatically straightening steel elements. The apparatus comprises a sensor associated with a lower roller that detects the vertical position of the element, a sensor associated with a measuring roll and a position detection roll, positioned in contact with the upper side of the element, to detect its position.

JPH06246341 discloses an automatic measuring device and a welded steel pipe control device. The patent illustrates a pair of devices detecting the outer diameter of the pipe, each providing distance sensors, opposed, in pairs, on the sides of a square-shaped frame inside which the pipe is suitable to be inserted passing therethrough.

JPS6182939 discloses an apparatus for correcting the curvature of a steel wire, comprising an automatic detection device of the x, y-coordinates of the wire cross-section, at the passage through a detection device.

Therefore, the need for automating this operation is felt, for example by means of known detection sensors, which, however, suffer from difficulties in the specific type of work, such as those related to the presence on the straightening apparatus work plane, of calamine powders, which can disturb the detection of positions taken by the rod on the same work plane.

Moreover, in the straightening and, if necessary, bending apparatuses of the iron rod, there is a need to leave free a large work space at the work plane to allow the handling of the element during the working step. Therefore, it is even more difficult to place the cited detection members in an suitable way suitable for an effective detection.

DISCLOSURE

The task of the present invention is that of solving the aforementioned problems, devising a method for automatically adjusting the straightening of metal elements of elongated shape, in particular iron rods, that allows to perform the straightening in an effective and precise way, in any working condition.

Within such task, it is a further scope of the present invention to provide an apparatus for automatically straightening metal elements of elongated shape, of simple constructive and functional conception, provided with reliable use, as well as relatively economic cost.

The cited scopes are reached according to the present invention by the method for automatically adjusting the straightening of metal elements of elongated shape according to claim 1 and by the apparatus for automatically straightening metal elements of elongated shape according to claim 7.

The method for automatically adjusting the straightening of metal elements of elongated shape provides to feed at least one metal element of elongated shape along a feeding direction, to detect a first datum, substantially a distance measurement, through a first detection member when the metal element of elongated shape crosses, with a respective cross-section, a first detection plane on which the first detection member is predisposed to detect. Then, the first measured datum is sent to an acquisition and processing device present in the same apparatus.

Subsequently, a second datum is detected, substantially another distance measurement, through a second detection member when the metal element of elongated shape crosses with a respective cross-section a second detection plane on which the said second detection member is predisposed to detect.

The second datum is then sent to the said acquisition and processing device, so that it can process the first acquired datum and the second acquired datum, to calculate, in an at least approximate way, the geometrical configuration instantaneously taken by the metal element in the space between the first detection plane and the second detection plane.

Finally, in case the calculated instantaneous configuration differs from a rectilinear desired configuration, that is, in case an anomaly is detected, the acquisition and processing device sends the control unit of the apparatus suitable data or signals indicating the size, the direction and the orientation of the said anomaly, to enable the straightening adjustment.

The control unit, upon receipt of the said signals indicating the anomaly, intervenes on the drawing and/or straightening apparatus, by sending corresponding adjustment commands.

According to a feature of the invention, at least one between the first detection member and the second detection member is arranged at the respective detection plane at the opposite side to the metal element being fed, with respect to the work plane, in particular below the work plane, thus being protected by the work plane itself.

Such arrangement ensures the maximum freedom of movement to the metal element, which is therefore not affected by the presence of the detection assembly.

The work plane preferably acts as a continuous covering element.

The said method, therefore, allows to carry out an adjustment, preferably continuous, of the straightening parameters in a completely automatic way.

The apparatus according to the invention, that carries out the aforementioned method, comprises a drawing and/or straightening assembly predisposed to feed along a feeding direction at least one metal element of elongated shape, in particular a metal rod, and a work plane, on which the said metal element of elongated shape is fed. The metal element of elongated shape, primarily preferably wound in a roll or on a coil, is unwound preferably by suitable unwinding means, for example a reel of known type.

Downstream of the said drawing and/or straightening assembly, preferably downstream of cut means or bending means, if provided, there is a preferably continuous detection assembly, comprising at least a first detection member, a second detection member and an acquisition and processing device for the data detected by the said detection members.

The first detection member is arranged in such a way as to detect at a first detection plane, transverse to the said feeding direction. The said first detection member is capable of detecting at least a first datum, indicating a measurement or a value of the distance between the first detection member and a cross-section of the metal element of elongated shape when the same cross-section crosses said first detection plane.

Preferably, the said first detection plane is substantially orthogonal to said feeding direction.

The second detection member cooperating with the said first detection member is arranged in a way so as to detect at a second detection plane, transverse to the said feeding direction and in succession with respect to the first detection plane in the same feeding direction. The second detection member is capable of detecting a second datum, indicating a measurement or value of the distance between the second detection member and a cross-section of the said metal element of elongated shape, in the moment when the said cross-section crosses the said second detection plane.

Preferably, the second detection plane is arranged orthogonal to the feeding direction.

At least one between the first detection member and the second detection member is arranged at the respective detection plane at a side opposite to the metal element being fed, with respect to the work plane, in particular below the work plane. thus being protected by the work plane itself.

The work plane preferably acts as a continuous covering element.

More precisely, the work plane is physically interposed between the at least one detection member and the metal element to be detected.

In this way, the metal element to be detected is maximally free to place itself, from the work plane itself, at the detection plane. In other words, the said at least one detection member does not physically occupy the half-space delimited by the work plane, in which the metal element is free to place itself.

The first detection member and the second detection member can be aligned along a longitudinal plane containing the said feeding direction, or can be staggered, for example rotated about the said feeding direction, thus allowing a respective reading from different corners, preferably from detection planes substantially orthogonal to the feeding direction. In this way, it is possible to obtain a more precise estimate of the configuration taken by the metal element being fed, thus resulting in a more precise adjustment.

The acquisition and processing device of the adjustment unit can acquire in continuous way the said first datum and the said second datum, coming from the first detection member and from the second detection member respectively, being capable of combining such data to estimate the instantaneous configuration taken by the metal element of elongated shape being fed along the said feeding direction. Identifying such configuration allows then to identify size and type of the anomaly shown by the metal element of elongated shape following the straightening operations occurring in the detection moment.

The combination of these distance values, performed by the acquisition and processing device associated with the first detection member and second detection member, allows thus to carry out, preferably instant by instant, thus in continuous way a precise estimation of the position on the first detection plane and/or on the second detection plane in corresponding way, of the cross-sections of the metal element of elongated shape, that progressively cross the respective detection planes, the first and the second, arranged in succession.

Therefore, the invention allows to identify in precise way the instantaneous configuration of the metal element of elongated shape being fed, by processing data sent by the detection members on at least two subsequent detection planes. This processing allows to detect possible deviations from a rectilinear theoretical configuration, to detect possible anomalies in the performed straightening and to send appropriate correction data to the control unit of the apparatus.

The detection assembly of the apparatus can therefore continuously and effectively monitor the straightening anomalies that may be present in the metal element being processed and, if necessary, calculate size and type of corrections to be applied by the drawing and/or straightening assembly, in order to restore the degree of straightness desired.

It is important to observe that the first detection member and the second detection member are arranged at a space of the apparatus in which the metal element is maximally free to arrange itself according to the residual tensions, remaining after the straightening operations.

Preferably, both the first and second detection members are arranged, with respect to the work plane, opposite to the metal element to be detected, at their respective detection planes.

In particular, the work plane, for example arranged in vertical or substantially vertical way, represents the only bound to the free arrangement of the metal element of elongated shape in the detection space of the first detection member and second detection member. Therefore, such detection members, as illustrated, can monitor and interpret the effects of the possible residual tensions present on the element, and allow a continuous adjustment.

Preferably, at least one between the first detection member and the second detection member is a proximity sensor of magnetoresistive type.

Preferably, both detection members, the first and the second, are proximity sensors of magnetoresistive type.

These magnetoresistive proximity sensors have the advantage not to be influenced by the presence of possible bodies, of suitable material, interposed between the metal element being fed, to be detected, and the detection members, as for example occurs in the presence of a continuous work plane, that serves also as covering for the apparatus. In this case the sensors that can be arranged at the opposite sides to the metal element to be detected, with respect to the work plane, in particular below the same work plane, being further pretected, for example from produced dust, that inevitably deposit on the work plane and in the surrounding zones.

These sensors can effectively detect the position of a cross-section of the mental element in a respective detection plane, independently from the irregularity of the outer shape.

Moreover, such specific arrangement of the sensors, at the side opposite to the metal element to be detected, with respect to the work plane, in particular below the work plane, has the advantage not to occupy the space available for the metal element being fed that is then maximally free to move and displace.

Preferably, at least one between the first detection member and the second detection member comprise a magnetic source arranged on the respective detection plane, a first magnetoresistive sensible element capable of emitting a first output signal and a second magnetoresistive sensible element capable to emit a second output signal, both signals indicating a distortion of the magnetic field generated by the said magnetic source at the passage of the cross-section of the metal element through the detection plane. Moreover, the said sensible elements are electrically disjointed. Each aforesaid detection member is associated with acquisition and processing means, for example integrated in the said acquisition and processing device itself, capable of processing the said first signal and second signal, determining, as a result, at least the value of a first coordinate and the value of a second coordinate, defining uniquely, univocally, the position of the baricentre of the cross-section passing on the respective detection plane.

Therefore, according to a specific aspect of the invention, in which the first detection member and the second detection member are of the aforesaid type, comprising each said magnetic source, a said first sensible element, a said second sensible element and being associated with acquisition and processing means, the apparatus according to the invention allows to obtain, instant by instant, the exact position of the baricentre of the cross-sections of the metal element of elongated shape, both on the first detection plane and on the following second detection plane. Consequently, the estimation of the configuration taken by the metal element being processed in the space defined between the first detection plane and the second detection plane, can be very precise. As a result, the adjustment instructions sent by the control unit to the drawing and/or straightening assembly is really effective.

A magnetoresistive proximity sensor of such type has been described by the Applicant in patent application PCT/IB2015/058185 and corresponding WO publication, WO 2016/063256 A1, the entire contents of each application are incorporated herein by reference.

Therefore, the processing device of the said adjustment unit can identify, instant by instant, the configuration taken by the metal element of elongated shape on the work plane between two detection planes, thus calculating the correction data to be possibly applied to the straightening parameters.

In practice, the correction unit according to the invention is capable of "codifying" and thus monitoring any anomaly of the metal element of elongated shape, with respect to a theoretical straightening result that could be reached by the drawing and/or straightening assembly working along the feeding direction.

According to a specific aspect of the invention, at one, at least, between the first detection plane and the second detection plane, at least a further detection member can be placed in addition to the first detection member and second detection member. For example, such further detection member can be placed in a way so as to be able to detect a direction rotated about the said feeding direction, with respect to the detection member already placed on the same detection plane or substantially on the same detection plane, thus providing a further datum to the acquisition and processing device, indicating a further measurement of the distance between the further detection member and the cross-section of the metal element being fed on the detection plane concerned.

Therefore, thanks to the detection of at least a couple of the said data or measurements, indicating respective distances on a same detection plane or substantially on the same detection plane, it is possible, through the acquisition and processing device, to calculate in precise way the position of the cross-section of the metal element, to which instantaneously refer the individual data or measurements, that is, of the cross-section that instantly crosses the detection plane concerned.

In practice, for example, when considering the first detection plane, the first detection member can detect the value of a first relative distance of said cross-section that instantly crosses the detection plane concerned, that is, the distance between the first detection member and the same section, while the further detection member may detect the value of a further distance on the same first detection plane of the same cross-section or, more correctly, of a point or contour of it, that is, the distance between the further detection member and the same cross-section. By combining the two measurements or distances, by means of a calculation method of the type of the triangulation, it is possible to accurately estimate the location of the section of the metal element substantially on the detection plane concerned, which is instantly observed by the detection members.

This estimate is made by identifying two circumferences on the plane of detection involved, the first having its centre in the first detection member and radius equal to the first detected distance and the second having its centre on the further detection member and radius equal to the further distance detected and determining, in substance, two points or two zones, at most, of intersection of the detected circumferences. More precisely, if the said circumferences are tangent or substantially tangent, the one intersection point will indicate univocally the position of the observed cross-section. Otherwise, if the circumferences intersect on substantially two points, that is, one of the two identified intersections will correspond to an excludible position, for example because this is placed in a space region, for example below the work plane, in which the metal element being worked cannot arrive, or because this is not coherent with the previous detections made on adjacent cross-sections.

The same principle can be applied, additionally or alternatively, to the second detection plane and to the relative possible detection members placed thereon.

According to the invention, one or more additional detection members can be advantageously provided, predisposed to cooperate to the detection of the exact position of the observed cross-section, according to what has been previously described. The presence of a plurality of detections on the same detection plane or substantially on a same detection plane increases the precision of the position calculation procedure.

It is to be observed that the presence of the work plane, physically present for some kind of processes according to different shapes, for example more or less extended, for manufacturing stirrups by suitable apparatuses, prevents the metal element of elongated shape, in particular the iron rod, from freely taking certain specific configurations. In other words, the presence of a work plane, for example, vertical or substantially vertical, enables the rod to flex freely, due to residual stresses, upwards or downwards as well as in the opposite direction to the work plane, while instead prevents inflections that, in the absence of bounds, would occur towards the work plan. The presence of at least two detection members that can read in successive detection planes, instead, allows estimating the curvature taken by the rod at the work plane, to identify to the type of anomaly and then, lastly, to determine the adjustment to be done.

This aspect, which is a prerogative of the invention, is particularly useful when the presence of the work plane affects the configuration of the rod. As described above, this is the case when the iron rod tends to flex against the work plane, but this flexion is prevented by the work plane itself.

In this specific case, it is advantageous, according to the claimed method, to detect the position of a cross-section, preferably of front end, in at least two successive instants: when it passes through the first detection plane and when it passes, subsequently, through the second detection plane.

Moreover, from the detection of at least one further intermediate datum concerning a distal cross-section, it is possible to identify, in particular, the condition in which the rod protrudes externally to the work plane, detecting a displacement compatible with such circumstance, for such distal cross-section.

In general, the detection of at least two readings, in successive instants or in the same instant, carried out on distant detection planes along the feeding direction by detection means protected by the work plane, allows to localize automatically and accurately the entity and the direction in the space of the anomaly possibly shown by the rod, and to bring the appropriate correction to the drawing and/or straightening assembly. As specified above, in fact, the presence of process residues, especially dust, on the work plane does not affect the measurements performed by the specific detection unit according to the invention, since it is protected, at least partially, by the work plane itself.

The comparison of the readings carried out in successive instants or at the same instant, depending on the type of anomaly, on the same sections or on different sections, respectively, can univocally indicate the orientation of the flexion which, abnormally, the rod can be subjected to in the straightening step.

BRIEF DESCRIPTION OF THE DRAWINGS

The details of the invention will become more apparent from the detailed description of a preferred embodiment of the apparatus for straightening metal elements, of elongated shape predisposed to carry out the method for automatically adjusting the straightening of the same elements, illustrated for indicative purposes in the attached drawings, wherein.

BEST MODE

Figure 1:
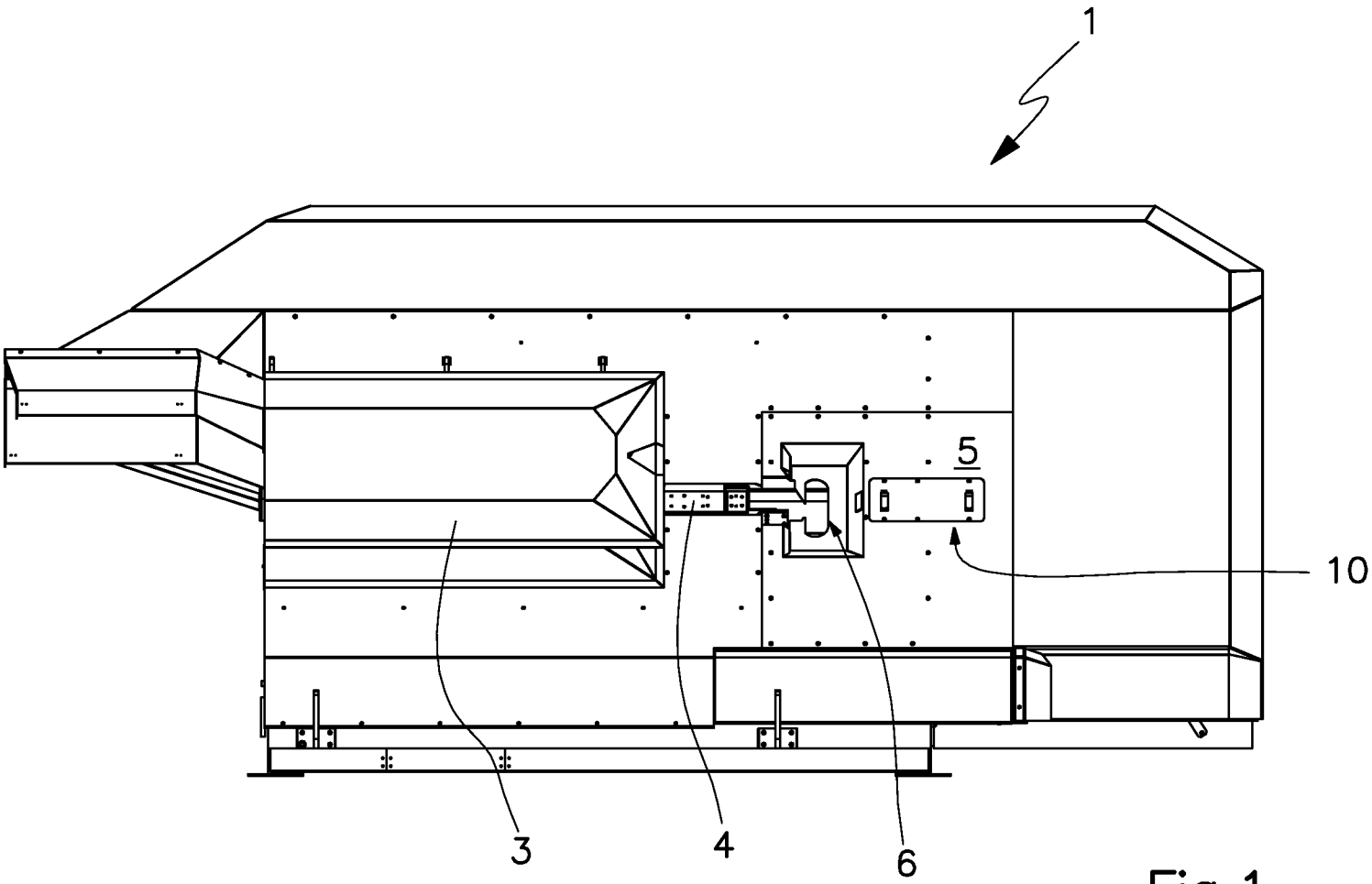
FIG. 1 shown a front view of the apparatus according to the invention.

With particular reference to FIGS. 1 to 3*c*, the apparatus for straightening metal elements 2 of elongated shape is indicated in its entirety with 1.

The apparatus 1 comprises a drawing and/or straightening assembly 3 of known type, a guide unit 4 at the edge of which a cut assembly is usually housed, arranged in succession along a feeding direction A of the metal element 2 or rod on a work plane 5. The apparatus possibly comprises also a bending unit arranged downstream of the guide unit 4 in a suitable seat 6 on the work plane 5.

Downstream of the guide unit 4 or in a space in which the rod 2 is free to arrange along the work plane 5, there is a detection assembly 10.

The apparatus comprises as well a control unit, predisposed to send the drawing and/or straightening assembly 3 adjustment instructions of the straightening parameters.

The detection assembly 10 comprises at least a first detection member 11 that reads on a first detection plane 21 transverse to the feeding direction A, downstream, according to the feeding direction A, of the drawing and/or straightening assembly 3, a second detection member 12 that reads on a second detection plane 22 transverse to the same feeding direction A, in succession to the first detection plane 21 with respect to the feeding direction A.

The first detection member 11 and the second detection member 12 are predisposed to detect at least one first datum and a second datum respectively, each indicating the instantaneous value of a respective distance from a cross-section of the rod 2 in the moment when it crosses the first detection plane 21 and the second detection plane 22 respectively.

The detection assembly 10 further comprises an acquisition and processing device of the first datum and second datum, outputting from the first detection member 11 and the second detection member 12, to calculate the instantaneous configuration of the rod 2 being fed along the feeding direction A.

Figure 2:
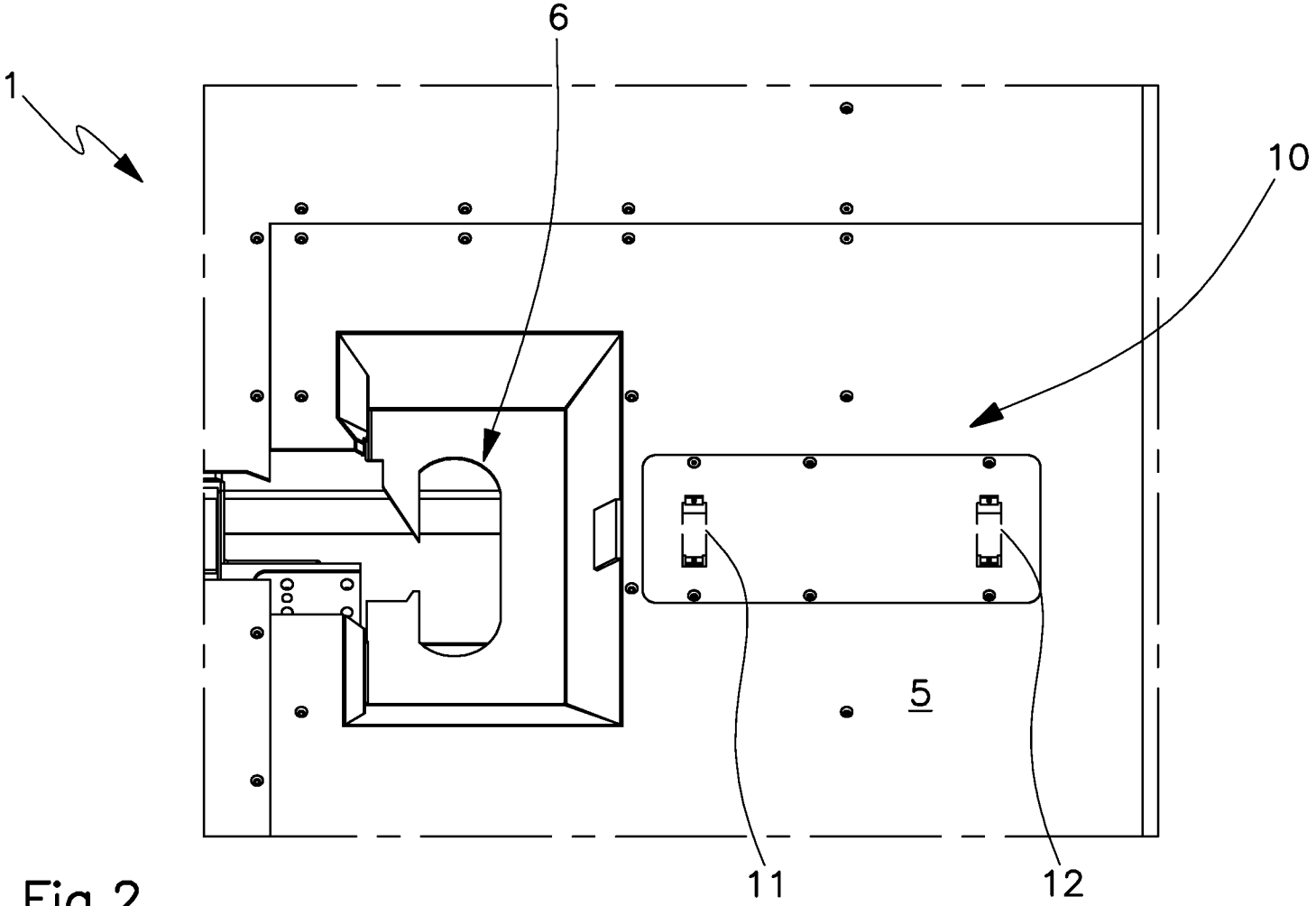
FIG. 2 shows a detail of the apparatus shown in FIG. 1.

The first detection member 11 and the second detection member 12 are arranged preferably below the work plane 5, protected by this latter (see FIG. 2, in which the first detection member 11 and the second detection member 12 are represented by the dotted line).

The first detection member 11 and the second detection member 12 are preferably proximity sensors of magnetoresistive type, of the type disclosed in patent application PCT/IB2015/058185 in the name of the Applicant and corresponding WO publication, WO 2016/063256 A1, the entire contents of each application are incorporated herein by reference.

In particular, such detection member, comprising a couple of magnetoresistive elements electrically disjointed, influenced by a same magnetic field source, allows to detect, on the respective detection plane, respective distortions of the resulting magnetic field, due to the passage of the metal element 2. The detection member 11, 12 then outputs a couple of coordinates, which indicate the exact position on the same detection plane of the cross-section of the metal element 2 passing therethrough.

Thus, the said specific detection members do not need to "see" the metal element 2, thus to be placed on the same side of the element with respect to the work plane 5, to read in precise and reliable way the instantaneous position of the element 2, useful for obtaining its instantaneous configuration and, therefore, any straightening anomalies.

Conversely, such detection members 11, 12 detect the passage of the metal element 2, even though they are protected by the work plane 5. In this way, they do not in any way interfere with the substantially free arrangement of the metal element 2 on the work plane 5, and with the necessary work space, especially if the element 2 is subjected to bending operations on the same work plane 5. In fact, in such case, the metal element 2 requires, around the bending assembly on the work plane 5, a large space free of hindrance, in which the different successively bent portions of the element 2 can rotate.

The acquisition and processing device can then send the control unit possibly detected data or signals indicating detected anomalies, if the calculated instantaneous configuration differs from a desired rectilinear configuration, so that the control unit can send corresponding adjustment commands to the drawing and/or straightening assembly 3.

The functioning of the apparatus for straightening elements of elongated shape according to the invention can be understood from the preceding description.

The first detection member 11 and the second detection member 12 are arranged in succession, with respect to the feeding direction A of the rod 2 at the first detection plane 21 and the second detection plane 22, respectively.

Such detection members are predisposed to detect, that is measure, the value of their distances from the cross-section of the rod 2 that cross the respective detection planes, so as to be able to estimate, thanks to the acquisition and processing device, the size and orientation of a possible anomaly of the configuration taken by the rod 2, with respect to the straightening axis represented by the feeding direction A.

The rod 2 is fed through the drawing and/or straightening assembly 3, being unwound from the respective coil, according to the feeding direction A.

The first detection member 11, being closer to the drawing and/or straightening assembly 3 of the second detection member 12, is the first to detect data.

Figure 3A:
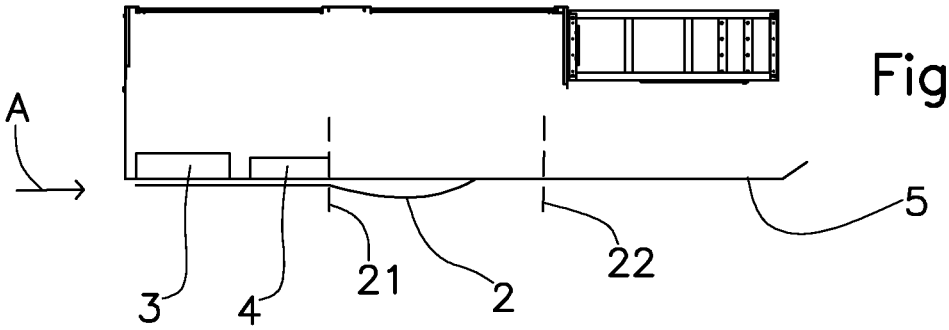
FIGS. 3*a*, 3*b* and 3*c* show a cross-sectional view of the apparatus, in subsequent working steps.
Figure 3B:
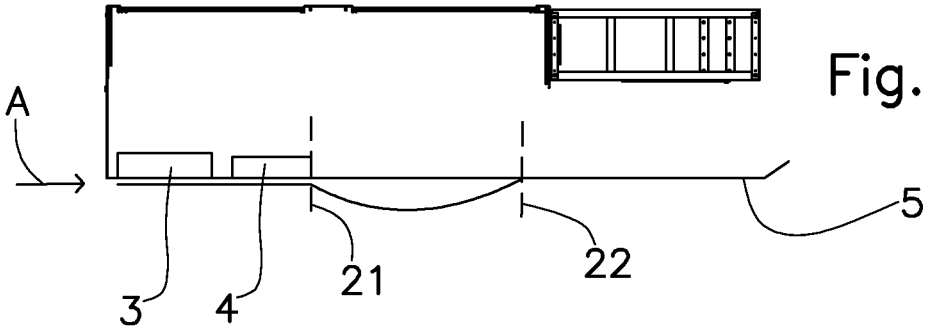

When the front end of the rod 2 reaches the first detection plane 21, the first detection member 11 detects the first datum, that is, the measurement of the distance between the first detection member 11 and the said front cross-section itself, and sends it to the acquisition and/or processing assembly (see FIG. 3*a*).

Following the continuous feeding of the rod 2 along the feeding direction A, the front end of the rod 2 reaches the second detection plane 22, where the relative distance is measured by the second detection member 12, that is, the second datum that is sent to the acquisition and processing device.

Preferably, the adjustment unit works continuously, thus the first detection member, in particular, keeps on sending data, that is, distance measurements, to the acquisition and processing device. In the case shown in the FIGS. 3*a* to 3*c*, this allows the device to compare the subsequent movements of the detected cross-section, that, in the shown case, moves from a condition adjoined or approached to the work plane 5, to a condition raised from the plane itself.

Thanks to the acquisition of such instantaneous data, coming both from the first detection member 11 and the second detection member 12, the acquisition and processing device can identify in precise way the configuration taken by the rod 2 in the work space between the first detection plane and the second detection plane.

The method according to the invention, carried out by the described apparatus 1, is capable to detect any type of anomaly presented by the rod 2 in straightening step despite the presence of the work plane 5, usually arranged vertically or inclined with respect to a vertical plane. This is, for example, the case of apparatuses for making stirrups.

As a matter of facts, in case the rod 2 tends to curve into one direction, in the space defined between the two indicated detection planes, that is, upwards, downwards or outwards, with respect to the work plane 5, the second detection member confirms the data detected by the first detection member and the acquisition and processing device can identify the size of the detected anomaly.

Figure 3C:
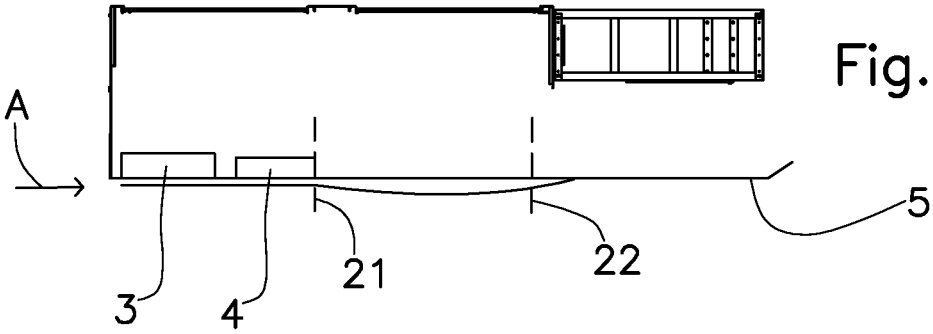

Conversely, in case the inner tensions of the rod 2 tend to bend it toward the work plane 5, and this constitutes an impediment to such free inflection, then the rod 2 arranges itself according to a profile which has at least one inflection, curving on the same work plane 5 (see especially FIG. 3*c*).

In fact, if the rod 2 tends to go towards the work plane 5, the first detection member 11 first reads that the end cross-section of the rod 2 is close to the work plane 5 as if the configuration thereof was perfectly straight.

Subsequently, the rod 2 advances by means of the drawing and/or straightening assembly 3 and, being subjected to stress pushing it against the work plane 5, it abuts against the work plane 5, crawling over it and arranging according to an arched profile on the work plane 5. Meanwhile, the first detection member 11 can detect that the cross-sections passing through the first detection plane 21, instant by instant, move away and then gradually approach to the work plane 5 (see FIG. 3*a*).

When the end of the rod 2 reaches the second detection member 12, this latter detects a position close to the work plane 5. From the combination of the sequence of these data, the acquisition and processing device can identify the anomaly shown by the rod 2 and indicate the value and type of correction to be made to the drawing and/or straightening assembly 3 (see FIG. 3*b*).

In other words, the data detected by the first detection member 11 are compared to those from the second detection member 12, which advantageously detects its data at a distance from the first detection plane 21, wherein the rod 2 can extend its own shape, fully showing possible anomalies.

For example, it is possible to highlight bigger bends present in the rod 2, through the apparatus according to the invention, by appropriately modulating the distance along the feeding direction A between the first detection plane 21 and the second detection plane 22.

In practice, the used materials as well as the size and shape may vary according to the needs.

Should the technical characteristics mentioned in the claims be followed by reference signs, such reference signs were included for the sole purpose of increasing the understanding of the claims and thus they shall not be deemed limiting the scope of the element identified by such reference signs by way of example.

The invention claimed is:

1. A method for automatically straightening of metal elements of elongated shape, the method comprising the steps of:

(a) prearranging a drawing and/or straightening assembly to straighten and feed at least one of the metal elements of elongated shape along a feeding direction, a work surface downstream of said drawing and/or straightening assembly, on which said at least one metal element is configured to be fed along said feeding direction and a control assembly configured to send adjustment commands for straightening parameters to said drawing and/or straightening assembly;

(b) prearranging a detection assembly comprising at least one first detection member configured to detect within at least one first detection plane transverse to said feeding direction, downstream, according to said feeding direction, of said drawing and/or straightening assembly, said detection assembly further comprising at least one second detection member configured to detect within at least one second detection plane transverse to said feeding direction, said at least one second detection plane being arranged in succession to said at least one first detection plane with respect to said feeding direction, said work surface being interposed between at least one of said at least one first detection member and said at least one second detection member and said at least one metal element when being fed along said feeding direction, at least one of said at least one first detection member and said at least one second detection member being protected by said work surface and said at least one metal element being freely mobile starting from said work surface at one or more of said at least one first detection plane and said at least one second detection plane, said at least one first detection member being configured to detect at least one first datum and said at least one second detection member being configured to detect at least one second datum, each of said at least one first datum and said at least one second datum indicating an instantaneous measurement of a respective distance from a cross-section of said at least one metal element of elongated shape in a moment when said at least one metal element passes respectively through said at least one first detection plane and said at least one second detection plane, said detection assembly further comprising an acquisition and processing device for said at least one first datum and said at least one second datum;

(c) feeding said at least one metal element of elongated shape along said feeding direction;

(d) detecting said at least one first datum by said at least one first detection member when said at least one metal element of elongated shape passes through said at least one first detection plane with a respective cross-section;

(e) sending said at least one first datum to said acquisition and processing device;

(f) detecting said at least one second datum by said at least one second detection member when said at least one metal element of elongated shape passes through said at least one second detection plane with said respective cross-section;

(g) sending said at least one second datum to said acquisition and processing device;

(h) processing said at least one first datum and said at least one second datum via said acquisition and processing device for estimating an instantaneous geometric configuration assumed by said at least one metal element in a space defined between said at least one first detection plane and said at least one second detection plane and for detecting a possible anomaly with respect to a desired geometric configuration of said at least one metal element;

(I) sending, by said acquisition and processing device to said control assembly at least one of said at least one first datum and said at least one second datum relative to said estimated configuration and said detected anomaly, so that said control assembly transmits corresponding straightening adjustments commands to said drawing and/or straightening assembly.

2. A method according to claim 1, wherein at least one of said at least one first detection member and said at least one second detection member is a proximity sensor, the proximity sensor being a type of magnetoresistive sensor.

3. A method according to claim 2, wherein said steps from (d) to (I) are carried out in continuous manner for a continuous adjustment of straightening of said at least one metal element of elongated shape.

4. A method according to claim 3, further comprising a step of sending at least one further first datum detected by said at least one first detection member in a moment intermediate between detection of said at least one first datum and said at least one second datum to said acquisition and processing device, wherein said step (h) of processing by said acquisition and processing device said at least one first datum and said at least one second datum comprises a further step of comparing said at least one first datum, said at least one second datum and said at least one further first datum, to estimate said instantaneous geometric configuration assumed by said at least one metal element in said space defined between said at least one first detection plane and said at least one second detection plane.

5. A method according to claim 2, wherein said respective cross-section is an end front portion of said at least one metal element of elongated shape, detected by said at least one first detection member and subsequently by said at least one second detection member.

6. A method according to claim 2, wherein said step (d) of detecting said at least one first datum and said step (f) of detecting said at least one second datum occur in a same instant on respective spaced cross-sections of said at least one metal element being fed.

7. A method according to claim 1, wherein the at least one metal element is a rod.

8. An apparatus for automatically straightening metal elements of elongated shape, the apparatus comprising:

a drawing and/or straightening assembly configured to feed and straighten at least one metal element of elongated shape along a feeding direction;

a work surface downstream of said drawing and/or straightening assembly, on which said at least one metal element is configured to be fed along said feeding direction;

a control assembly configured to send instruction for straightening parameters to said drawing and/or straightening assembly;

a detection assembly comprising at least one first detection member configured to detect within at least one first detection plane transverse to said feeding direction, downstream, according to said feeding direction, of said drawing and/or straightening assembly, the detection assembly further comprising at least one second detection member configured to detect within at least one second detection plane transverse to said feeding direction, said at least one second detection plane being arranged in succession to said at least one first detection plane with respect to said feeding direction, said work surface being interposed between at least one of said at least one first detection member and said at least one second detection member, said at least one metal element being fed along said feeding direction, at least one of said at least one first detection member and said at least one second detection member being protected by said work surface and said at least one metal element being freely mobile starting from said work surface at one or more of said at least one first detection plane and said at least one second detection plane, said at least one first detection member being further configured to detect at least one first datum and said at least one second detection member being configured to detect at least one second datum, each of said at least one first datum and said at least one second datum indicating an instantaneous measurement of a respective distance from a portion of said at least one metal element of elongated shape in a moment when said at least one metal element passes respectively through said at least one first detection plane and said at least one second detection plane, said detection assembly further comprising an acquisition and processing device of said at least one first datum and said at least one second datum for processing the instantaneous configuration assumed by said at least one metal element of elongated shape in the space defined between said at least one first detection plane and said at least one second detection plane along said feeding direction and for sending possible straightening adjustment commands to said control assembly, in case said instantaneous processed configuration varies from a desired configuration.

9. An apparatus according to claim 8, wherein at least one of said at least one first detection member and said at least one second detection member is a proximity sensor, said proximity sensor being a type of magnetoresistive sensor.

10. An apparatus according to claim 9, wherein said detection assembly works continuously, said at least one first detection member and said at least one second detection member being configured to continuously detect said at least one first datum and said at least one second datum and at least one of a further first datum and a further second datum, for respective portions of said at least one metal element progressively being fed, and to send said at least one first datum and said at least one second datum and said at least one of said further first datum and said further second datum to said acquisition and processing device.

11. An apparatus according to claim 10, wherein at least one of said at least one first detection member is oriented on said at least one first detection plane and said at least one second detection member is oriented on said at least one second detection plane so as to be able to detect said distance, substantially perpendicular to said feeding direction.

12. An apparatus according to claim 9, further comprising at least one further detection member between said at least one first detection member and said at least one second detection member and is protected by said work surface, said at least one metal element being freely mobile starting from said work surface at said respective detection plane.

13. An apparatus according to claim 12, wherein said at least one further detection member is a proximity sensor, the proximity sensor being a type of magnetoresistive type.

14. An apparatus according to claim 9, further comprising at least one of a guide and a cut assembly downstream of said drawing and/or straightening assembly, said at least one first detection member and said at least one second detection member being disposed downstream of said guide and/or cut assembly, with respect to said feeding direction, so as to be able to detect the position of portions of said at least one metal element to be straightened, in a space in which said at least one metal element is maximally free to arrange itself on the work surface.

15. An apparatus according to claim 8, further comprising at least one further detection member arranged within at least one of said at least one first detection plane and said at least one second detection plane, said at least one further detection member being configured to detect a further datum indicating a respective further distance of said portion of said at least one metal element being fed, and to send said further datum to said acquisition and processing device, said acquisition and processing device being configured to calculate an exact position of said cross-section passing therethrough, calculated with respect to at least one of said at least one first detection plane and said at least one second detection plane by processing at least one of said at least one first datum and said further datum.

16. An apparatus according to claim 15, wherein said at least one further detection member is between said at least one first detection member and said at least one second detection member and is optical.

17. An apparatus according to claim 15, wherein said at one further detection member between said at least one first detection member and said at least one second detection member is a laser.

18. An apparatus according to claim 8, wherein said at least one of said at least one first detection member and said at least one second detection member comprises a magnetic field source arranged within at least one of said at least one first detection plane and said at least one second detection plane, a first sensible magnetoresistive element configured to emit a first output signal and a second sensible magnetoresistive element configured to emit a second output signal, said first sensible element and said second sensible element being electrically disjointed, said first output signal and said second output signal being indicative of a distortion of a magnetic field generated by said magnetic source at the passage of one said portion of said at least one metal element through at least one of said at least one first detection plane and said at least one second detection plane, each of said at least one first detection member and said at least one second detection member being associated with said acquisition and processing means, configured to process said first signal and said second signal, and to determine, as a result, a value of a first coordinate and a value of a second coordinate on at least one of said at least one first detection plane and said at least one second detection plane, defining uniquely an instant position of a barycenter of a passage portion on said respective detection plane.

19. An apparatus according to claim 8, wherein said at least one metal element is an iron rod.

* * * * *